US005367369A

United States Patent [19]

Nakai et al.

[11] Patent Number: 5,367,369

[45] Date of Patent: Nov. 22, 1994

[54] IMAGE HEATING APPARATUS CAPABLE OF CONTROLLING NUMBER OF WAVES IN AC POWER SUPPLY

[75] Inventors: Hironobu Nakai, Yokohama; Shokyo Koh, Kawasaki, both of Japan

[73] Assignee: Canon Kabushiki Kaisha, Tokyo, Japan

[21] Appl. No.: 45,307

[22] Filed: Apr. 12, 1993

[30] Foreign Application Priority Data

Apr. 10, 1992 [JP] Japan ..... 4-118392

[51] Int. Cl.[5] ..... G03G 15/20

[52] U.S. Cl. ..... 355/285; 355/290; 219/216; 219/492

[58] Field of Search ..... 355/285, 290; 219/216, 219/492, 497, 501

[56] References Cited

U.S. PATENT DOCUMENTS 4,998,121 3/1991 Koh et al. ..... 346/160
5,043,763 8/1991 Koh et al. ..... 355/206
5,149,941 9/1992 Hirabayashi et al. ..... 219/216
5,179,263 1/1993 Koh et al. ..... 219/216
5,225,874 7/1993 Koh et al. ..... 355/285

*Primary Examiner*—Joan H. Pendegrass
*Attorney, Agent, or Firm*—Fitzpatrick, Cella, Harper & Scinto

[57] ABSTRACT

An image heating apparatus including a heater which is stationary in use; a film movable together with a recording material in sliding contact with the heater, an image on the recording material being heated through the film by the heat from the heater, in a predetermined heating width; power supply source for supplying alternating power to the heater; a controller for controlling a number of waves of the power imparted to the heater in a predetermined unit of time; wherein the unit of time, a moving speed of the film, and the heating width of the heater satisfy:

the unit of time≦(the heating width)/(the film speed).

5 Claims, 10 Drawing Sheets

IMAGE HEATING APPARATUS CAPABLE OF CONTROLLING NUMBER OF WAVES IN AC POWER SUPPLY

FIELD OF THE INVENTION AND RELATED ART

The present invention relates to an image heating apparatus of a through-film heating type comprising a heat generating member which generates heat as power is supplied, and a heat resistance film to be delivered while remaining in contact with said heater, wherein a recording material is passed together with said film, across the location of said heater while being pressed against said film on the surface opposite to the one facing said heater, whereby the thermal energy from said heater is transferred through said film to an image carried on the recording material.

This apparatus is employed for fixing an unfixed image, improving the surface properties of a toner image, or the like.

As for the image heating apparatus for carrying out the fixing operation or related process by heating the image carried on the recording material, a heat roller type has been widely used. However, recently, a system comprising a fixed heater and a moving film has been proposed, for example, in the U.S. Pat. Nos. 5,149,941 and 5,043,736, wherein the heater generates heat toward a nip and the film slides on the heater.

Such a through-film heating system can afford reducing the thermal capacity of the heater, making it possible to save energy and reduce the waiting time.

If a heater with such a fast response as described above is used with electric power exceeding an adequate amount, the temperature may rise too high due to the fast rising speed, and if the supplied power is less than the proper amount, the temperature may not reach a predetermined point due to fast falling speed, increasing the temperature ripples during the temperature control.

In view of the above described problem, it is preferable to control the power to be supplied to the heater.

As for the method for controlling this power, there are the phase control system in which the phase of AC is controlled, or the PWM control system in which the pulse width of DC is controlled.

However, there are such problems that the AC phase control system generates periodical large noises, and that DC-PWM control system requires a complicated control circuit.

Thus, a wave nun%her control system has been proposed in which control is executed using a period from a zero point to the next zero point of the AC power source as a basic unit of a control block.

In comparison to the phase control and PWM control, this wave number control is not capable of achieving a precise control.

Therefore, the through-film heating system having large temperature fluctuations creates a problem, in other words, when the heater is not generating heat, the heater temperature suddenly drops as the material is passed to be heated, resulting in heating irregularity (irregular fixing).

Further, though it is possible to control the number of waves in response to the condition of the AC power source, this method can switch the amount of power only by a halfwave increment within a predetermined control period, and therefore, the amount of the power fluctuation cannot be sufficiently absorbed, resulting in the deterioration of the power switching accuracy, which is a problem.

SUMMARY OF THE INVENTION

The object of the present invention is to provide an image heating apparatus in which the number of waves in the AC power can be controlled.

Another object of the present invention is to provide an image heating apparatus in which the number of waves of the AC power can be controlled without causing heating irregularity.

The preferred embodiment of the present invention comprises a heater which is stationary in use and a film which moves together with a recording material while sliding on the heater, power supplying means for supplying AC power to the heater, and control means for controlling the number of waves in the AC power supplied to the heater within a predetermined unit of time, wherein an numerical formula: Unit of time≦Heating width/Film delivery speed, is satisfied.

Further objects of the present invention will be manifested in the following description.

DESCRIPTION OF THE PREFERRED EMBODIMENT

Figure 1:
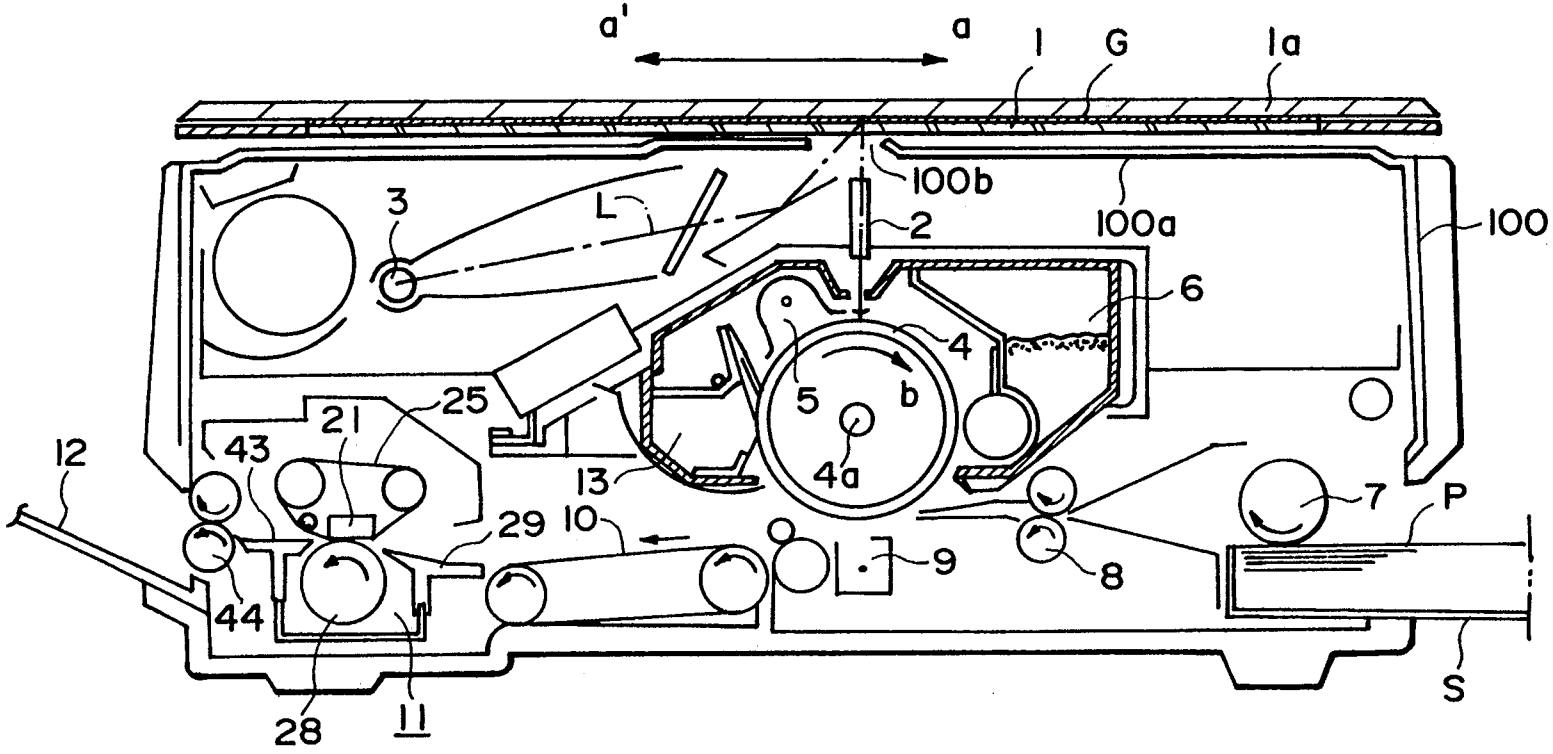
FIG. 1 is a schematic side view of an embodiment of an image forming apparatus according to present invention, depicting its structure.

FIG. 1 is a cross-sectional view of an image forming apparatus according to an embodiment of the present invention as the image heating apparatus.

Reference numeral 100 designates an apparatus casing. Reference numeral 1 designates a reciprocating original carrier comprising a transparent platen such as a glass plate, and is placed above the top plate 100*a* of this case. This original carrier is reciprocally driven at a predetermined speed across the top plate 100*a* of the casing, rightward (a) first, and then, leftward (b) as indicated in the drawing. Reference character G designates the original, which is set on the upper surface of the original carrier 1, in alignment with a predetermined index, wherein, the original surface bearing the image to be copied is faced downward, and then, an original pressing plate 1*a* is placed to cover the original.

Reference numeral 100b designates a slit opening as an original illuminating opening, which is formed in the top plate 100a of the casing 100, extending perpendicular (perpendicular to the sheet of the drawing) to the direction in which the original carrier 1 is reciprocated. The downward facing image carrying surface of the original G placed on the original carrier 1 is passed over the slit opening 100b, from the right side end to the left side end as the original carrier 1 is moved forward, that is, rightward (a). Meanwhile, the image carrying surface is scanned by light L emitting from a fluorescent lamp 3 through the slit opening 100b and transparent original carrier 1. This scanning light is reflected by the image carrying surface of the original and is focused by an array 2 of small diameter image forming elements with a short focal point, on the surface of a photosensitive drum 4, thereby exposing this surface to the formed image.

The photosensitive drum 4 comprises a coated surface layer of photosensitive material such as zinc oxide, organic semiconductor, or the like, and is rotated about its center axis 4a at a predetermined peripheral speed in the clockwise direction as indicated in an arrow (b). Meanwhile, the photosensitive layer is uniformly charged to positive or negative polarity, by a charger 5. As this uniformly charged surface of the drum is exposed (slit exposure) to the above mentioned focused image of the original, an electrostatic latent image is serially formed on the surface of the photosensitive drum 4, reflecting the optical image originating from the original and being focused on the photosensitive drum 4.

This electrostatic latent image is serially visualized, in a developer 6, with toner consisting of resin or the like which softens and melts when heated, and then, this visualized toner image is moved to the location of a transfer discharger 9 as a transferring member.

Reference character S designates a cassette loaded with transfer sheets P as the recording material. The sheets within this cassette are dispensed out one by one by the rotation of the feed roller 7, and its conveyance is synchronized by the register roller 8 so that the arrival of the leading edge of the transfer sheet P at a position between the transfer discharger 9 and photosensitive drum 4 coincides with the arrival of the leading edge of the toner image carried on the drum 4 at the location of the transfer discharger 9. Then, the toner image on the photosensitive drum is serially transferred by the transfer discharger 9 onto the timely delivered transfer sheet 9.

The transfer sheet on which the toner image has been transferred is peeled off from the photosensitive drum 4 by an unshown separating means, and is guided by a conveying apparatus 10 to a fixing apparatus 11, which will be described later. The unfixed toner image carried on the transfer sheet 9 is thermally fixed in the fixing apparatus 11, and then, the transfer sheet 9 carrying now the fixed toner image is discharged as a copy, through a discharge roller 44, into an external discharge tray 12.

The surface of the photosensitive drum 4 is cleaned by a cleaning apparatus 13 after the transfer of the toner image, to remove adhering contaminants such as the residual toner from the transfer operation, and is repeatedly used for image formation.

Figure 2:
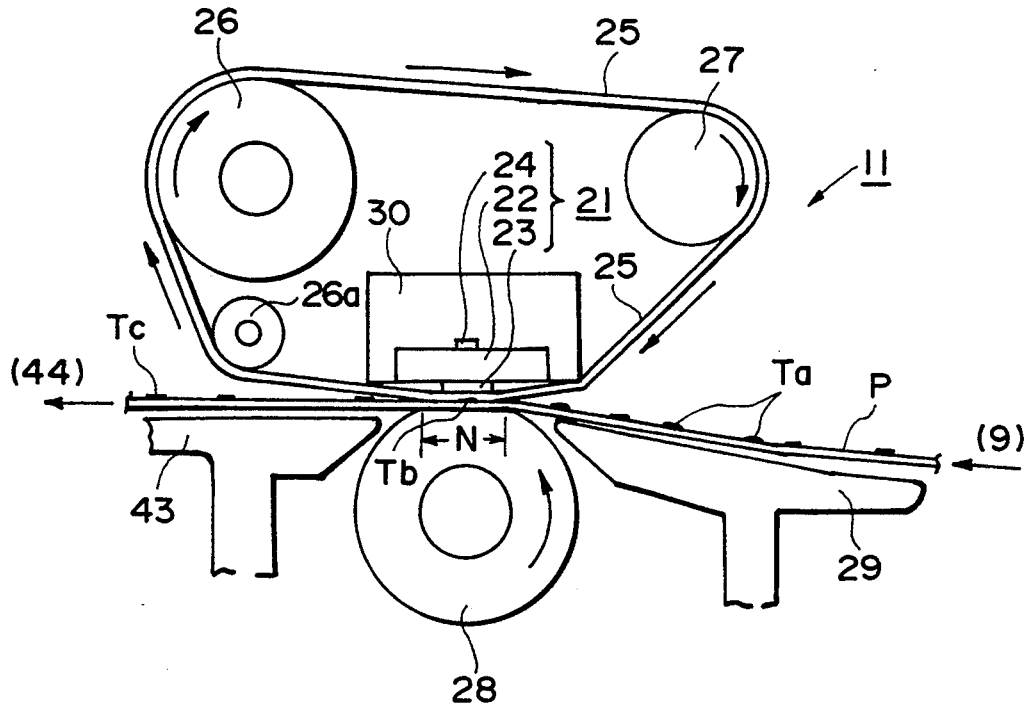
FIG. 2 is a schematic side view of the fixing apparatus, depicting its structure.
Figure 3:
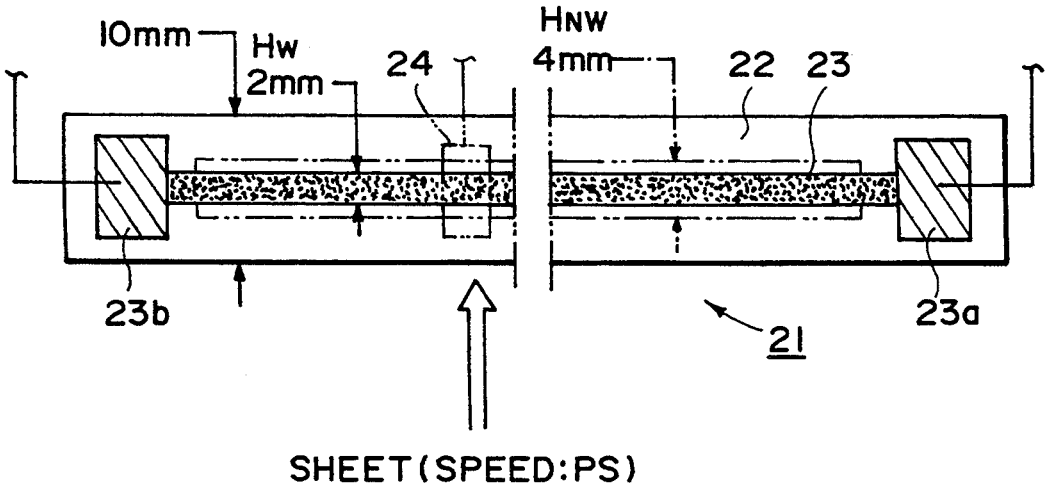
FIG. 3 is a partial plan view of the heating member (heater), depicting the surface where a layer of a heating resistor member is formed.

FIG. 2 is a cross-sectional view of the fixing apparatus 11 according to the embodiment of the present invention, and FIG. 3 is a partial plan view of the resistance heater, depicting the surface where the layer of the heating resistor member is formed.

Reference numeral 25 designates a heat resistant endless fixing film, which is extended around four members: a driving roller 26 on the right, a follower roller 27 on the left, a heater 21 as a linear heating member of low thermal capacity mounted fixedly below the mid point between the rollers 26, 27, and a guide roller 26a provided below the driving roller 26, wherein all of these four members are parallel to each other.

The follower roller 27 also works as a tension roller for the endless fixing film 25, whereby, as the driving roller 26 is rotated in the clockwise direction, the endless fixing film 25 can be driven in the clockwise direction without wrinkling, snaking, and losing the speed, at a predetermined peripheral velocity which is the same as the delivery speed of the transfer sheet P, that is, the recording material, delivered from the image forming station (9) while bearing on the top surface an unfixed toner image $T_a$.

Reference numeral 28 designates a pressure roller as a pressuring member comprising an elastic layer of rubber material having excellent parting properties, such as silicon rubber. The pressure roller 28 is pressed by a spring loading means against the bottom surface of the heater 21, with an overall contact pressure of 4 kg to 7 kg, wherein the fixing film 25 of endless belt configuration becomes sandwiched between the heater 21 and pressure roller 28 as it travels through the lower section of its path, and rotates in the counterclockwise direction, which is the same as the conveyance direction of the transfer sheet P.

As to the material for the fixing film 25, thin monolayer or multilayer film which excels in heat resistance, parting properties, and durability is used since the rotatively driven endless belt of the fixing film 25 is repeatedly used for fixing thermally the toner images. Generally speaking, the overall thickness of the film is no more than 100 μm, preferably no more than 40 μm thick.

In this embodiment, the base film is an approximately 20 μm thick heat resistant resin such as polyimide, polyetherimide, PES, PRA (co-polymer of tetrafluoroethylene fluoro-alkyl-vinylether resin), on which a coating layer of PTFE (tetrafluoroethylene resin), PAF, or the like, which has parting property, is applied to an approximate thickness of 10 μm on the base film on the surface which is contactable with the image.

The heater 21 as the heating member in this embodiment is a heater with small overall thermal capacity, which basically comprises: a heater substrate 22 which extends in the direction substantially perpendicular to the conveyance direction of the transfer sheet 9 and has insulating property, strong heat resistance, and low thermal capacity; a heating resistor layer 23 printed on one surface of the substrate, extending in the longitudinal direction of the substrate: and a thermistor 24 as a heater temperature sensor element provided on other surface of the substrate opposite to the surface where the heating resistor layer is formed. The heater 21 is mounted on a heater holder, exposing the surface where the heating resistor layer is formed.

The heater holder 30, which holds the heater 21 in a thermally insulating manner, is made of highly heat resistant resin such as PPS (Polyphenylsulfide), PAI (polyamideimide), PI (polyimide), PEEK (polyether etherketone), liquid crystal polymer, or a composite material composed of a combination of these resins, ceramic, metal, glass, or the like.

The heater substrate 22 is a substrate of aluminum or composite material containing aluminum, measuring 1.0 mm thick, 10 mm long, and 270 mm long, for example.

Referring to FIG. 3, the heating resistor layer 23 is coated (screen printing or the like) approximately in the middle portion on the bottom surface of the heater substrate 22, to a width of 2.0 mm, extending in the longitudinal direction of the heater substrate 22, and is made of electrically resistive material such as Ag/Pd, $RuO_2$, or $Ta_2$. In order to supply the power to the heating resistor layer 23, voltage is applied between electrodes 23*a*, 23*b* provided at each end, respectively.

The amount of electricity to be supplied is controlled through the temperature sensor element 24, so that the temperature of heater 21 is controlled by supplying the electrical power corresponding to a predetermined Mount of thermal energy radiated from the heater 21.

The surface of the heater 21 where the heating resistor layer 23 is formed may be covered with a surface protective layer of thin heat resistant glass or the like so that the surface is prevented from being worn out by the film which slides on the heater while being conveyed.

Next, the fixing operation will be described.

The image forming apparatus forms an image in response to an image formation start signal. The transfer sheet P delivered from the image forming station (9) to the fixing apparatus 11 enters between the fixing film 25 and pressure roller 28 in a pressure contact nip N (fixing nip) formed between the temperature-controlled heater 21 and the pressure roller 28, and passes through the nip N while being subjected to the pressure from the fixing nip N, with the unfixed toner image surface being tightly pressed against the bottom surface of the film 25 which is moving at the same speed and in the same direction as the transfer sheet P, without wrinkling or surface deviation.

While the sheet P passes through the fixing nip N, the surface bearing the toner image is compressed against the film surface and is subjected to the heat from the heater 21 through the film 25, whereby the toner image is melted by the high temperature to be softened and adhered onto the surface of the sheet P, forming $T_b$.

In the case of the apparatus of this embodiment, the sheet P, that is, the recording material, and the film 25 is separated at the time when the sheet P comes out of the fixing nip N.

While the sheet P separated from the film 25 is guided by a guide 43 toward a pair of discharge rollers 44, the toner $T_b$ temperature higher than the glass transition point naturally drops down (self-cooling) to a point below the glass transition point, at which the toner $T_b$ hardens to become $T_c$, and then, the sheet P bearing at this time the fixed image is discharged onto a tray.

Figure 4:
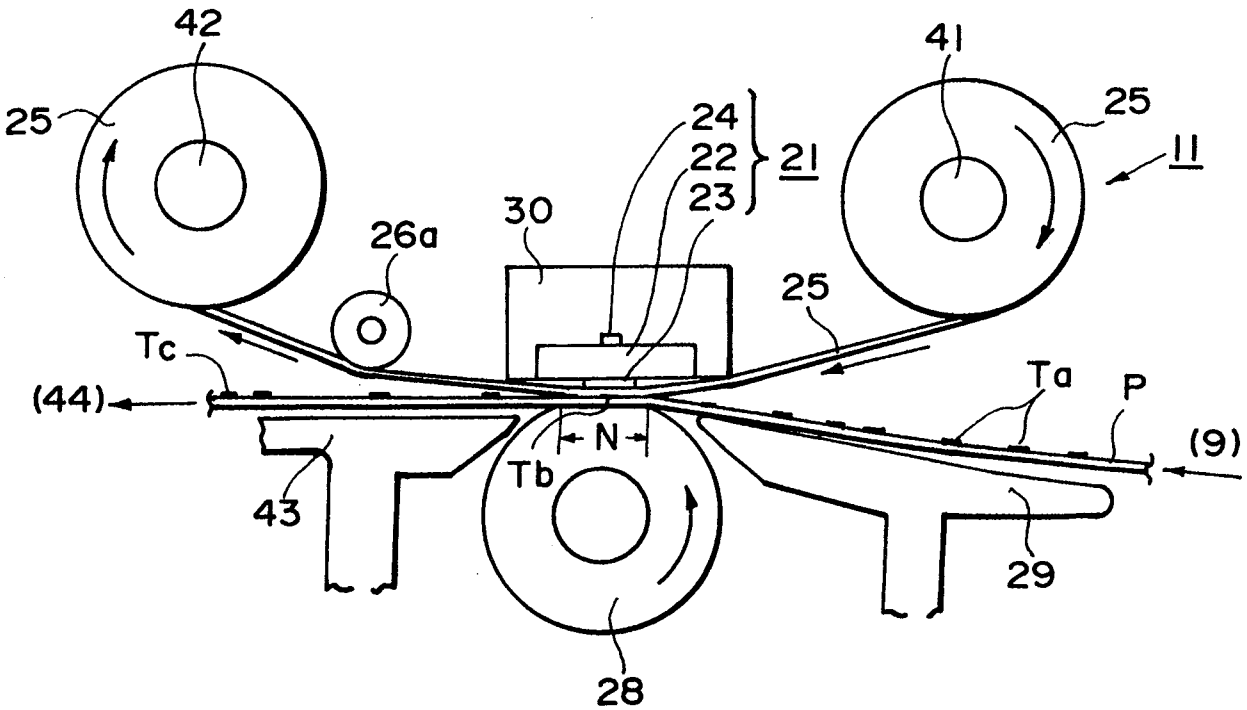
FIG. 4 is schematic side view of another example of the fixing apparatus.

The configuration of the film 25 is not limited to the endless belt. It may be as shown in FIG. 4. In other words, the structure may be such that a roll of fixing film 25 wound around a delivery shaft 41 is passed between the heater 21 and pressure roller 28, and underneath the guide roller 26*a*, and is engaged to a take-up roller 42, wherein this fixing film 25 is made to run from the delivery shaft 41 to the take-up shaft 42 at the same speed as the transfer sheet P.

Figure 5:
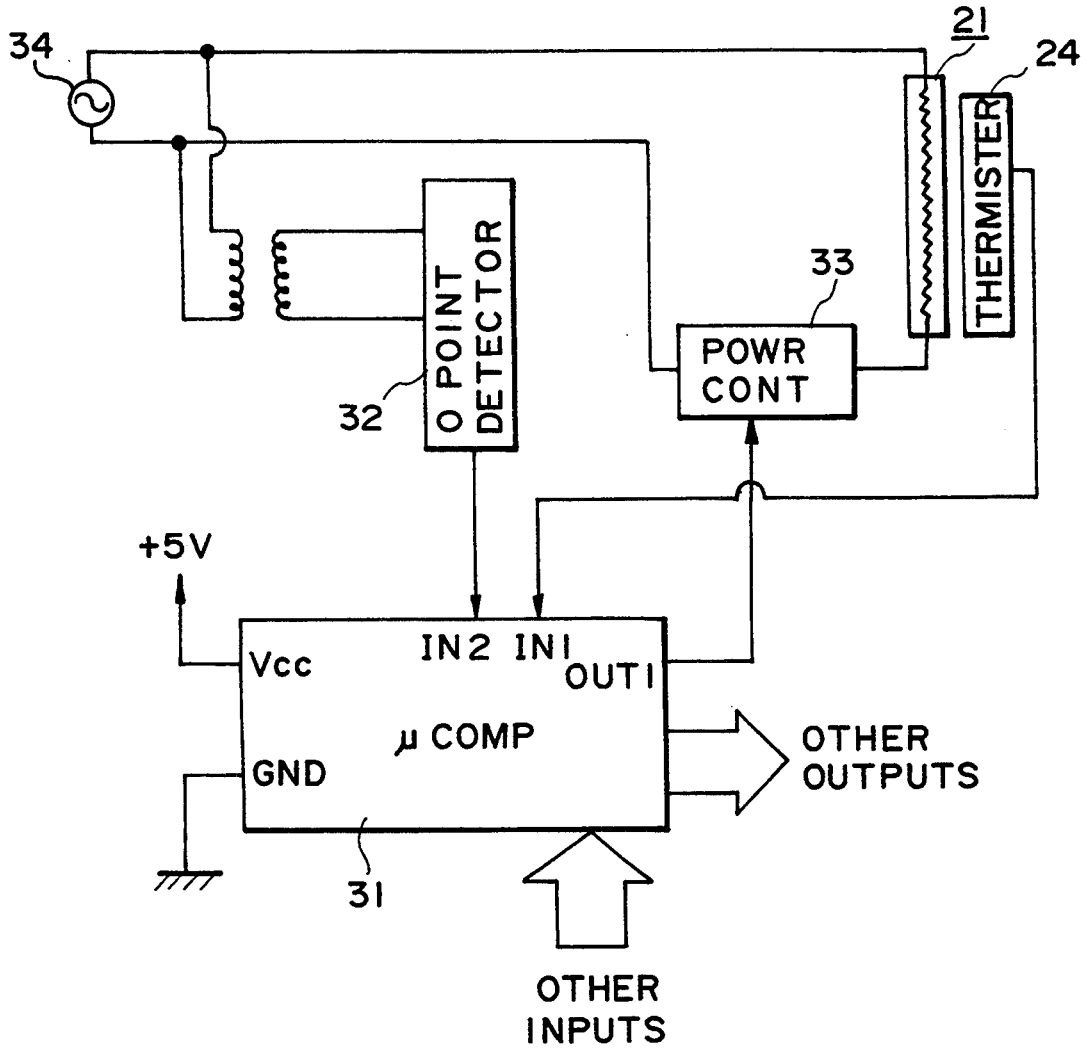
FIG. 5 is a block diagram of the heater control for Embodiment 1.
Figure 6:
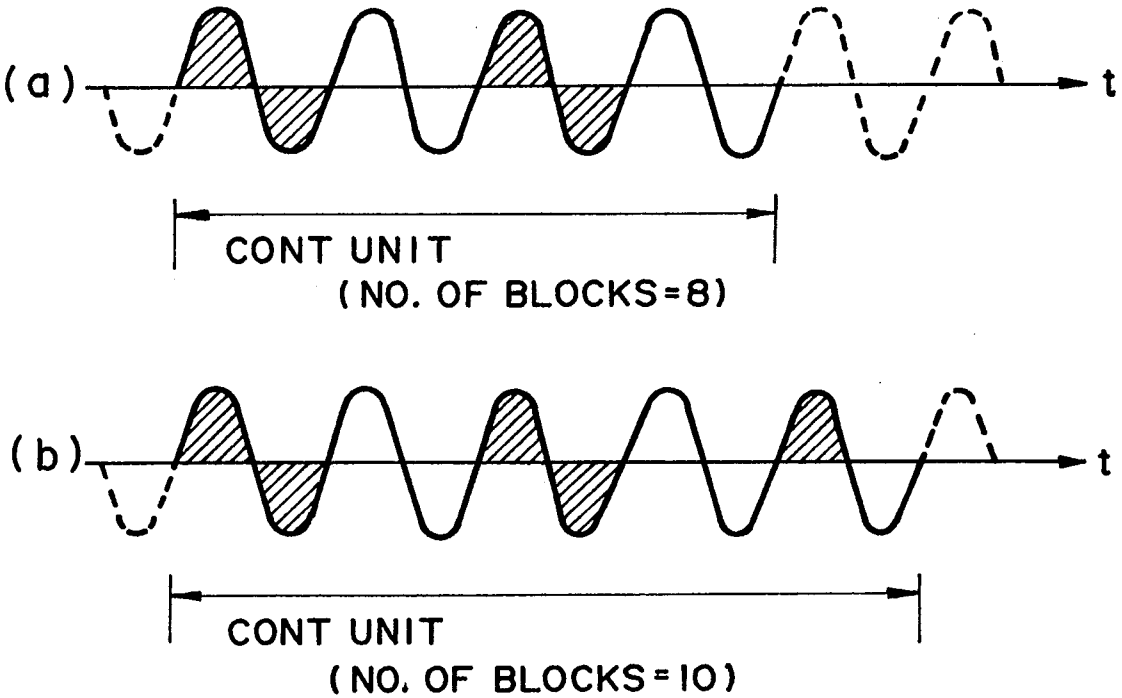
FIG. 6 is an explanatory drawing for describing the power supply control.

Next, referring to FIGS. 5, 6, a description is given as to how the power supply to the heater is controlled.

FIG. 5 is a block diagram for controlling the power supply to the heater.

Reference numeral 34 designates an AC power supplying means. Reference numeral 31 designates a controlling means, which constitutes a microcomputer, logic element, or the like in this embodiment. To the input terminal IN 1, the output value of the thermistor 24 as the temperature detecting element of the heater 21 is inputted for detecting the temperature of the heater 21.

Reference numeral 32 designates a zero point detecting means for detecting the zero voltage timing of the AC power supply 34. The output from the zero point detecting means (32) is inputted to an input IN 2 of the controlling means 31, and the controlling means 31 outputs a signal for controlling the electric power supplied to the heater 21 in response to the signal coming through the IN 2.

Reference numeral 33 designates a power supply control apparatus (power supply controlling means), which constitutes a switching means such as a TRIAC, or the like. The power is supplied to the heater 21 in response to the output signal of the control means 31.

The controlling means 31 is connected to other input and output terminals for controlling the copying sequence of the image forming apparatus, and further, it contains ROMs, RAMs, or the like in which the copying operation sequence programs and the likes are stored.

To a $V_{cc}$ terminal, a +5 V DC power source is connected, and the GND terminal is connected to ground.

As for controlling the power supplied to the heater 21, the power between one zero point to the next zero point of the AC power source 34 is used as the minimum unit in one control block, and the power is supplied on basis of a control block, which comprises a controlled number of the minimum units.

The power to the heater 21 is controlled by regulating the number of waves imparted to the heater in this control unit. For example, let it be assumed that the control unit comprises eight waves, and a 1000 W heater is used with a 100 V AC power supply having a stable frequency. If the power needs to be controlled to 500 W, only four waves are imparted in the control unit. If the control unit comprises ten waves, the control is executed to impart only five waves.

FIG. 6 shows an example of the above described case. In FIG. 6, (a) represents the case in which the control unit comprises eight waves, and (b) represents the case in which the control unit comprises ten waves. The waves with slanted lines are the ones to be supplied. The minimum unit of the electric power is determined by the number of waves within the control unit, and in the case of the above mentioned heater, the power can be controlled by an increment of 125 W if the control unit comprises eight waves, and by an increment of 100 W if the control unit comprises ten waves.

If the frequency f of the AC power source 34 is 50 Hz; the delivery speed of the paper (transfer sheet) through the image forming apparatus is 25 mm/sec; and the width $H_W$ of the heating resistor layer as the heating member is 2 mm, the above mentioned control unit satisfies following numerical formula.

$$\tfrac{1}{2}f \times (\text{unit block of control}) \leqq H_W/PS$$

In the case of the above embodiment, the control unit comprises eight waves. At this time, the power is supplied at least once while the paper is passing through the heat generating portion, whereby heating becomes stable, preventing fixing irregularities.

If more than one frequency is available, the decision is to be made with reference to the minimum frequency. For example, the control is executed using 50 Hz or 60 Hz, the selection is made with reference to 50 Hz, which also satisfies the above mentioned formula with regard to 60 Hz, and therefore, there is no problem.

Embodiment 2

In the fixing apparatus in Embodiment 1, the film 25 made of polyimide or the like has inferior thermal conductivity compared to the heater substrate 22 (aluminum substrate). Therefore, when the power is supplied to the heating resistor layer 23, the heat is also transferred to the heater substrate 22, whereby the transfer sheet P as the material to be heated is not only heated by the film across the width corresponding to the width $H_W$ of the heating resistor layer 23, but also, is heated by the mass of the fixing nip N. In this case, the control unit satisfies following numerical formula, $H_{NW}$ (FIG. 3) being the width of the fixing nip N.

$$\tfrac{1}{2}f \times (\text{unit block of control}) \leqq H_{NW}/PS$$

For example, if the frequency f of the AC power source 34 is 50 Hz; the paper delivery speed PS of the image forming apparatus is 25 mm/sec; and the width of the fixing nip is 4 mm, the control unit comprises less than 16 waves. This example is particularly effective when the heat has been accumulated in the heater 21 after a continuous image forming operation or a like operation.

Figure 7:
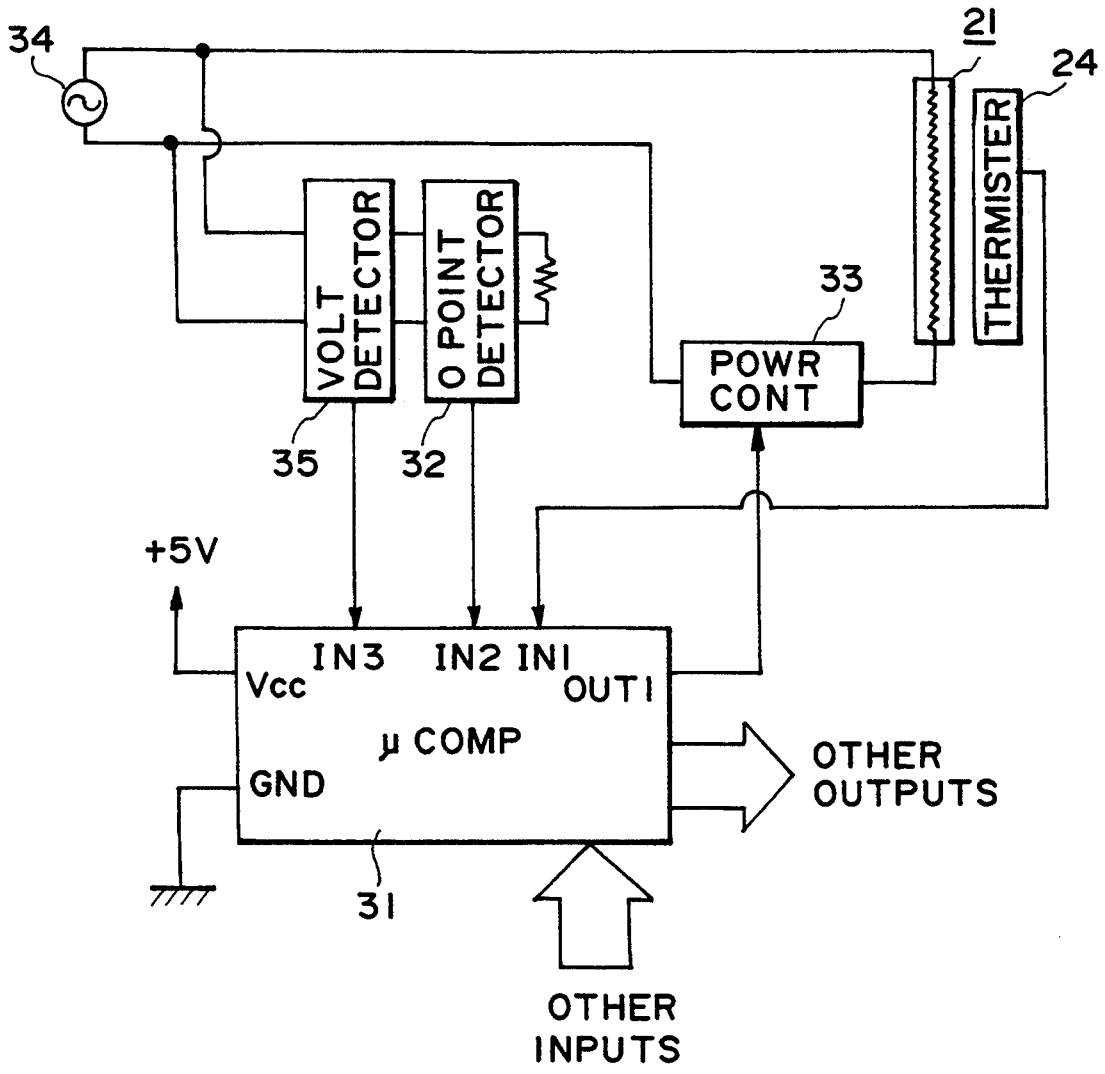
FIG. 7 is a block diagram for the heater control for Embodiment 3.
Figure 8:
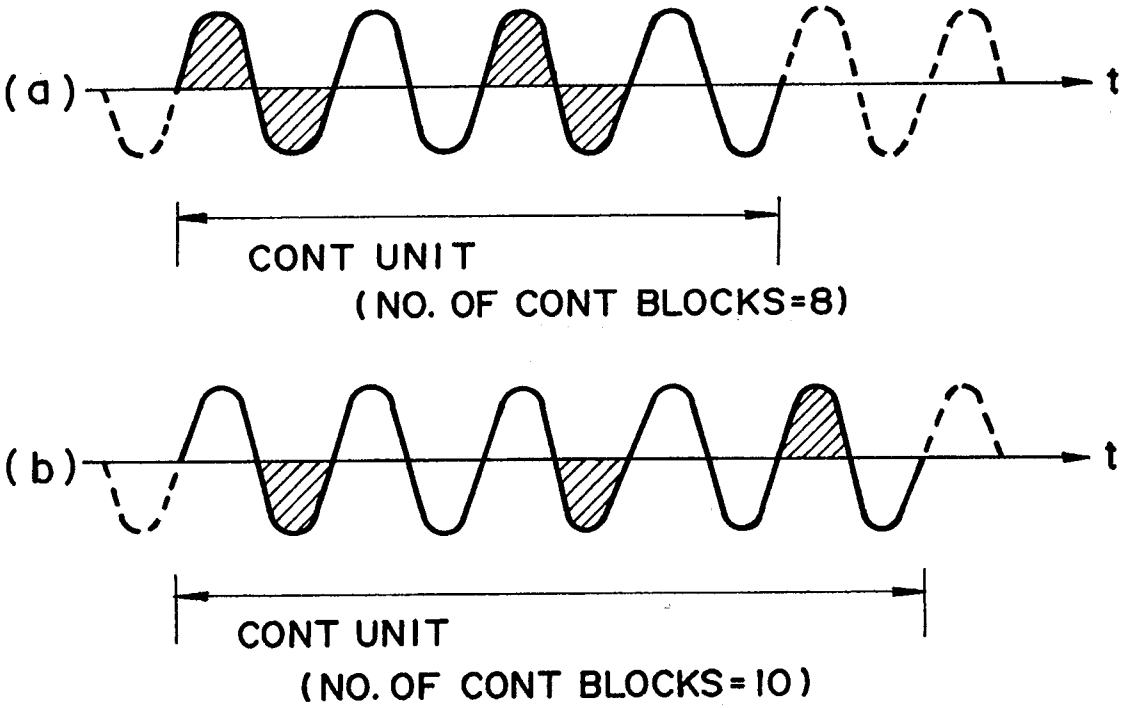
FIG. 8 is an explanatory drawing for describing the power supply control.
Figure 9:
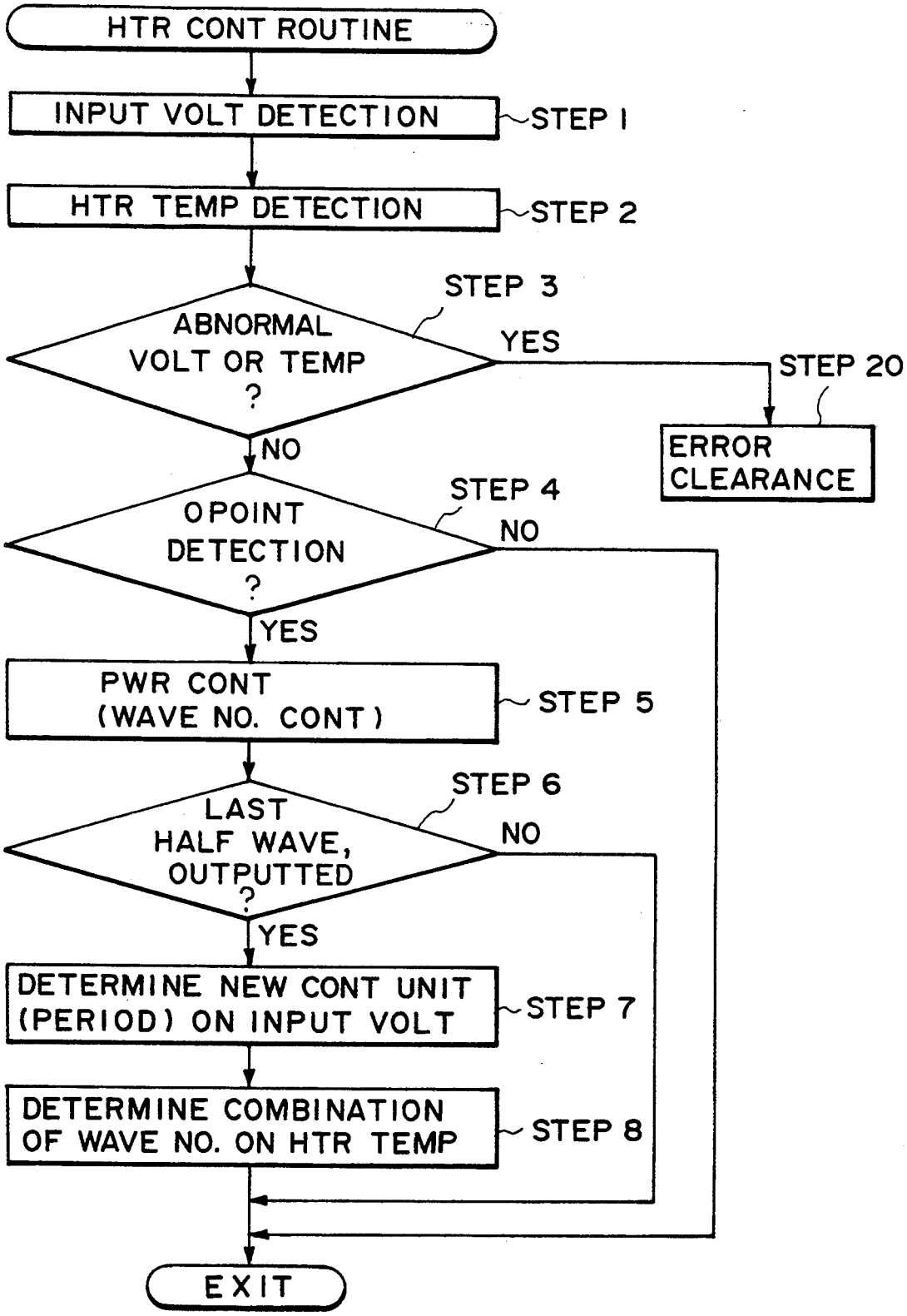
FIG. 9 is a flow chart of the control program.

Embodiment 3 (FIGS. 7 to 9)

In this embodiment and the following embodiment 4, the description of the hardware structure of the image forming apparatus and the fixing apparatus 11 is omitted since they are identical to Embodiment 1 (FIGS. 1 to 3).

FIG. 7 is a block diagram of the power supply control for the heating member (heater). In comparison to the power supply control block diagram for Embodiment 1 shown in FIG. 5, there is a difference in that a voltage detecting member 35 is provided for detecting the voltage of the AC power source 34. Otherwise, everything is identical, for which the description is omitted.

The voltage of the AC power source 34 is translated by the voltage detecting member 35 into a form suitable to be inputted to the microcomputer 31, and is fed to an input terminal IN 3 of the microcomputer 31. Similarly, the zero point of the AC power source 34 is translated by the zero point detecting member 32 into the signal suitable to be inputted to the microcomputer 34, and is fed to the input terminal IN 2.

The power supply control for the heater 21 is the same as Embodiment 1, wherein the period from a zero point of the AC power source 34 to the next zero point is adopted as the minimum unit of control cycle, whereby the power is controlled on the basis of the number waves in the minimum unit of control cycle. In other words, the power to be supplied to the heater 21 is controlled by controlling the number of waves supplied during the unit of control cycle.

For example, if the unit of control cycle comprises eight waves; the voltage of the AC power source is 100 V; and a 1,000 W heater (that is, the resistance value of the heater is 10Ω) is wanted to output 500 W, the power is supplied by only four waves. If the unit of control cycle comprises 10 waves, the power is supplied by five waves.

FIG. 8 shows the example. In FIG. 8, (a) represents the case in which the unit of control cycle comprises eight waves, and (b) represents the case in which the unit of control cycle comprises 10 waves. The waves with slanted lines are the waves by which the power is supplied.

The minimum control unit of power supply is determined by the number of waves in the unit of control cycle. In the case of the above described heater, the control can be executed by an increment of 125 W if the unit of control cycle comprises eight waves, and by an increment of 100 W if the unit of control cycle comprises ten waves.

FIG. 9 is a flow chart of a heater temperature control program.

This program is also stored in the internal ROM of the above described microcomputer, and is called for execution from the main sequence program or the like, with a predetermined interval or as needed.

First, in Step 1 immediately after a heater control routine is started, the input voltage at this point of time is detected through a signal sent from the voltage detecting member 35 to the IN 3.

Similarly, in Step 2, the temperature of the heater 21 at this point of time is detected through a signal sent from the thermistor 24 to IN 1.

In Step 3, it is discriminated whether or not the input voltage or heater 21 temperature detected in Steps 1 or 2, respectively, falls beyond a predetermined range which corresponds to the normal operation of the apparatus. If it is normal, Step 4 is taken, and if not, the program skips to Step 20.

Step 20 is an error clearance routine, which is an endless loop in which all of the outputs throughout the apparatus (in the case of this embodiment, throughout the copying apparatus) are turned off, and an error message is displayed by an appropriate type of display means, preventing the execution of the main program.

In Step 4, the zero point of the AC power source is detected through a signal inputted from the zero point detecting member 32 to the IN 2. If the zero point is not detected, the program skips to the exit of this loop. If the zero point is detected, Step 5 is taken, in which the power supply to the heater is controlled.

In Step 5, each time the zero point of the alternate current is detected, a signal is outputted from an output terminal OUT 1 to the power supply control 33, following the sequence of the wave number combinations selected in Step 8 during previous execution of this routine, whereby the power supply to the heater 21 is turned on or off.

In Step 6, it is discriminated whether or not the power supply control based on the unit of control cycle selected in Step 7 during the previous execution of this routine is completed. If it is in the process of executing the unit of control cycle, the program skips to the exit of this routine, and if the last half wave in the unit of control cycle has been imparted, Step 7 is taken.

In Step 7, a new unit of control is formulated in response to the information with regard to the input voltage detected in Step 1. Here, the unit of control may be formulated based on the calculation using the voltage and a predetermined function, or may be determined using a table stored in advance as a table of data in the ROM. It is also acceptable to define an upper limit value, lower limit value, or both of them, and formulate the unit of control cycle within the boundary of these limits.

Next, in Step 8, the number and combination of waves are selected so that the desired amount of power is obtained in the newly formulated unit of control cycle. Also in this case, the number of waves may be calculated using a predetermined function and the amount of imparted power, or may be determined using a table stored in advance as a table of data in the ROM. After the completion of the above steps, the program goes out of this heater control routine.

Table 1 presents a case in which the power control according to this embodiment was executed, and another case in which the prior power control was executed. In these cases, the resistance value of the heating member (heater) is 10Ω, and the desired electric power is to generate 400 W. In the case of the prior power control, the power error is as high as 10.25%, but in the case of this embodiment, the power error is suppressed to a maximum of 6.25%, and also, there is less power variation.

TABLE 1

| Effective value of power source volt. ($V_{rms}$) | Power control in Embodiment 3 | | | Conventional control | | |
|---|---|---|---|---|---|---|
| | Control block No. | Output No. of waves | Power | Control block No. (const.) | Output No. of waves | Power |
| 80 | 6 | 4 | 427 | 10 | 6 | 384 |
| 85 | 7 | 4 | 413 | 10 | 6 | 434 |
| 90 | 8 | 4 | 405 | 10 | 5 | 405 |
| 95 | 9 | 4 | 401 | 10 | 4 | 361 |
| 100 | 10 | 4 | 400 | 10 | 4 | 400 |
| 105 | 11 | 4 | 401 | 10 | 4 | 441 |
| 110 | 12 | 4 | 403 | 10 | 3 | 363 |
| 115 | 13 | 4 | 407 | 10 | 3 | 397 |
| 120 | 14 | 4 | 411 | 10 | 3 | 432 |

Resistance of heater = 10Ω
Desired power = 400 W

Figure 10:
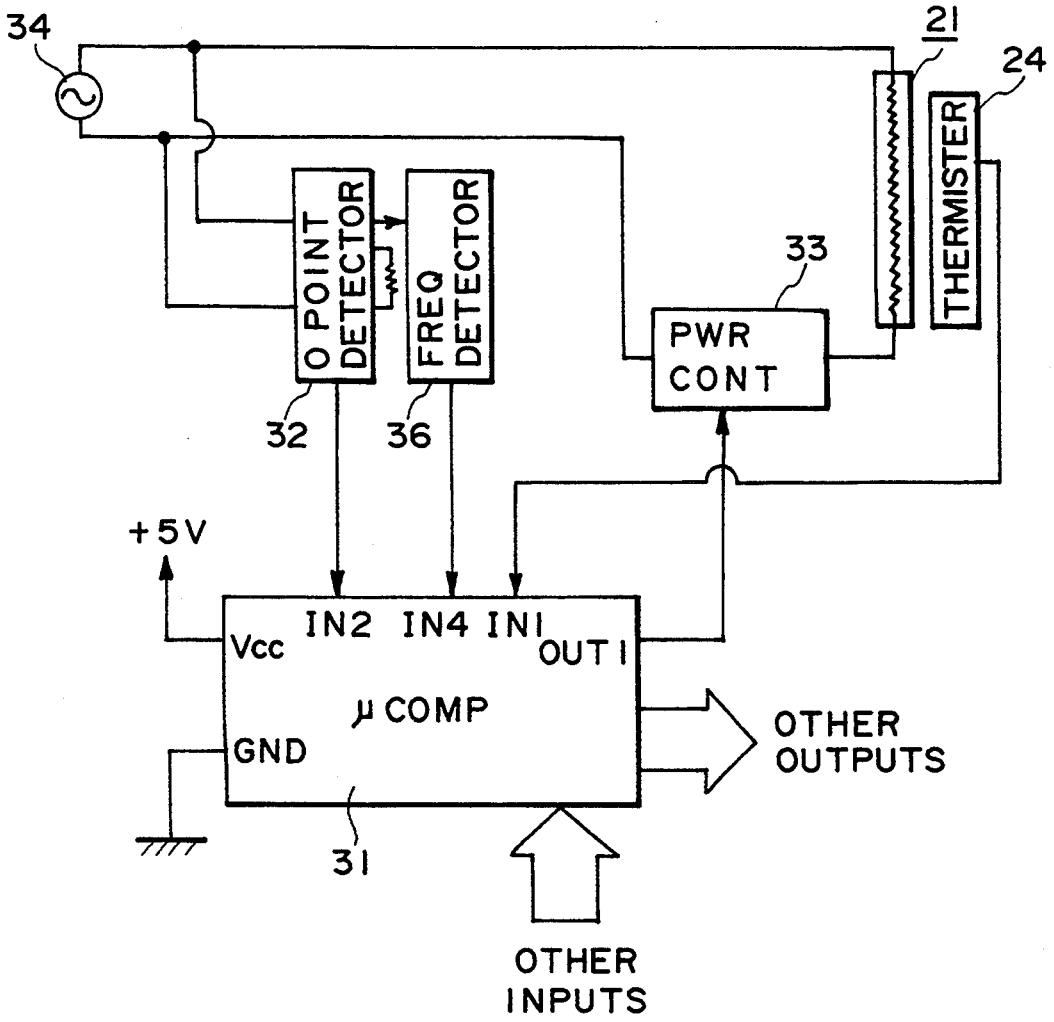
FIG. 10 is a block diagram of the heater control for Embodiment 4.
Figure 11:
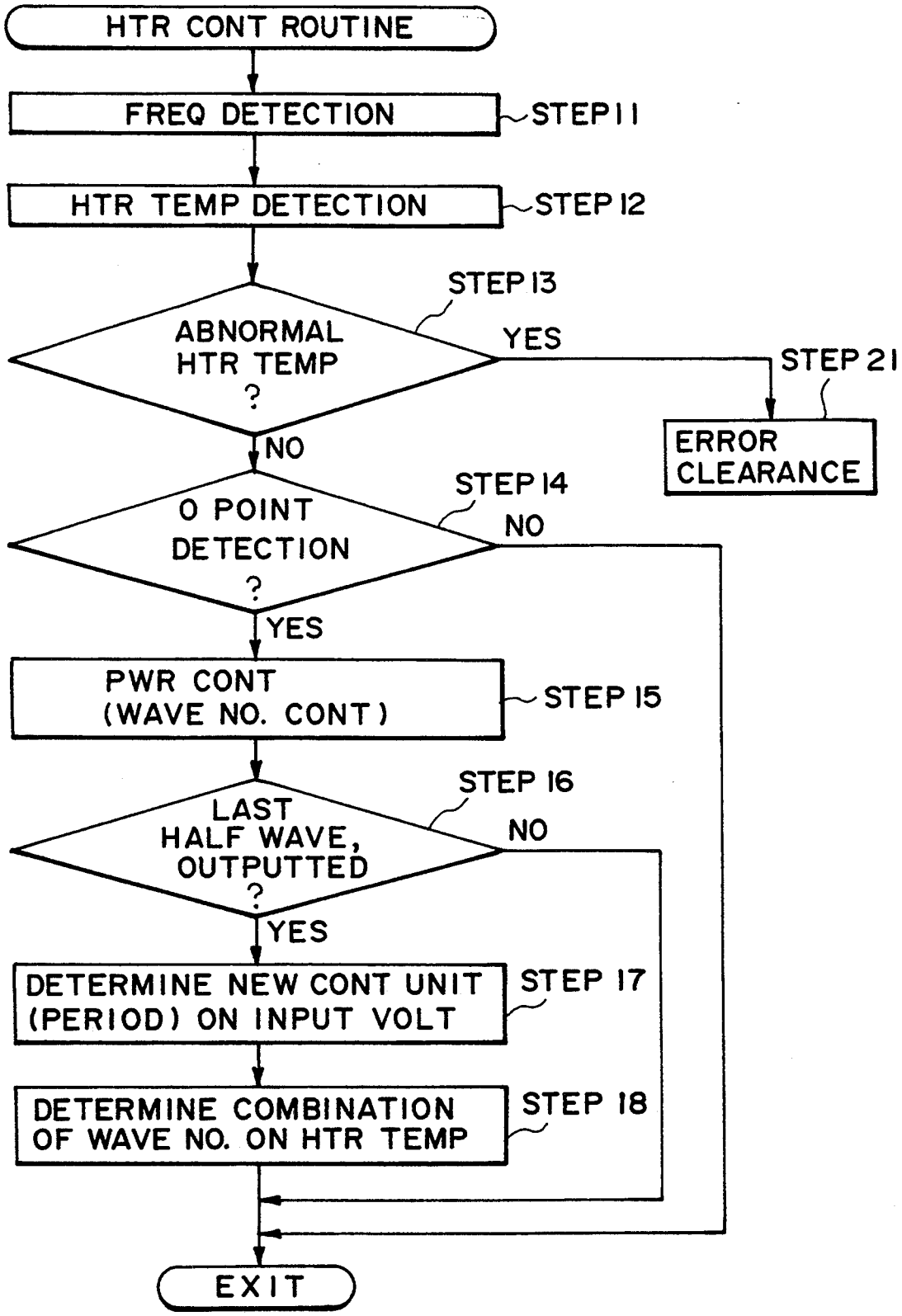
FIG. 11 is a flow chart for the control program.

Embodiment 4 (FIGS. 10, 11)

FIG. 10 is a block diagram of the heater control for this embodiment.

This embodiment comprises a frequency detecting member 36 for detecting the frequency of the AC power source 34. In the frequency detecting member 36, the power source frequency is detected by measuring the time interval between a zero point to the next zero point of the AC power source 34, based on the output signal from the zero point detecting member 32, and this data is sent to an input terminal IN 4 of the microcomputer 31. Otherwise, the structure is identical to the block diagram in the above described Embodiment 3, and therefore, repetition of the same description is avoided.

The power supply to the heater 21 is controlled by adopting the interval between a zero point to the next zero point of an AC power source as the minimum unit of control cycle, wherein a block of a predetermined number of waves between a zero point from the next zero point is imparted on the heater. The method for controlling the control block is as stated above.

FIG. 11 is a flow chart of the heater temperature control program. This program is also stored in the internal ROM of the microcomputer 31, and is called for execution from the main sequence program or the like, with a predetermined interval or as needed.

In Step 11 after the heater control routine is started, the frequency of the power source at this point of time is detected through a signal inputted from the frequency detecting member 36 to the IN 4.

Similarly, in Step 12, the heater 21 temperature at this point of time is detected through the signal inputted from the thermistor 24 to the IN 1.

In Step 13, it is discriminated whether or not the heater 21 temperature detected in Step 12 falls within the predetermined range which corresponds to the normal operation of the apparatus. If it is determined to be normal, Step 14 is taken, and if not, the program skips to Step 21.

Here, Step 21 is an error clearance routine, which constitutes an endless loop which turns off all the outputs throughout the apparatus (in this embodiment, throughout the copying machine), preventing the execution of the main program, while displaying an error message by an appropriate type of displaying means.

In Step 14, the zero point of the AC power source is detected through the signal inputted from the zero point detecting member 32 to the IN 2. If the zero point is not detected, the program skips to the exit of this loop, and if detected, Step 15 is taken, in which the power supply to the heater is controlled.

In Step 15, each time the zero point of the AC current is detected, a signal is outputted from the OUT 1 to the power supply control 33, following the sequence of the number and combination of the waves formulated in Step 18 during the previous execution of this routine, whereby the power is supplied to the heater or cut off.

In Step 16, it is discriminated whether or not the power supply control based on the unit of control cycle formulated in Step 7 during the previous execution of this routine is completed. If it is in the middle of executing the unit of control cycle, the program skips to the exit of this routine, and if the last half wave in the unit of control cycle has been imparted, Step 17 is taken.

In Step 17, a new unit of control is formulated in response to the information with regard to the input voltage detected in Step 1. Here, the unit of control cycle may be formulated based on the calculation using a given function between the number of waves and amount of imparted power, or may be stored in advance as a table of data in the ROM. It is also acceptable to define an upper limit value, lower limit value, or both of them, and formulate the unit of control cycle within the boundary of these limits.

Next, in Step 18, the number and combination of waves are selected so that the desired amount of electric power is supplied in the newly formulated unit of control cycle. Also in this case, the number of waves may be calculated using a given function between the number of waves and the amount of imparted power, or may be stored in advance as a table of data in the ROM.

After the completion of the above steps, the program goes out of this heater control routine.

Table 2 presents the results from a case in which the power supply control according to this embodiment was executed, and another case in which the prior power supply control was executed. In the cases presented here, the resistance value of the heating member (heater) was 10Ω, and the power source voltage was 100 $V_{rms}$. In the case of the prior power supply control, the control interval changed in response to the power source frequency. However, in the case of the power supply control according to this embodiment, the control interval change was held within a given range even when the power source frequency changed, and also, the number of control blocks was increased in proportion to the increase in the frequency, whereby the power switching accuracy was improved.

TABLE 2

| | Power control in Embodiment 2 | | | Conventional power control | | |
|---|---|---|---|---|---|---|
| Freq. of power source (Hz) | Control block No. | Control interval (ms) | Switching (W) | Control block No. | Control interval (ms) | Switching (W) |
| 40 | 8 | 100 | 125 | 10 | 125 | 100 |
| 45 | 9 | 100 | 111 | 10 | 111 | 100 |
| 50 | 10 | 100 | 100 | 10 | 100 | 100 |
| 55 | 11 | 100 | 91 | 10 | 91 | 100 |
| 60 | 12 | 100 | 83 | 10 | 83 | 100 |
| 65 | 13 | 100 | 77 | 10 | 77 | 100 |
| 70 | 14 | 100 | 71 | 10 | 71 | 100 |

Resistance of heater = 10Ω
Volt of power source = 100 $V_{rms}$ (const.)

As described above, according to the present invention, in a through-film type heating apparatus, or in an image forming apparatus comprising the through-film heating type heating apparatus as the image heating fixing apparatus, the above described control method is adopted as the power supply control method, in which the number of waves to be imparted is controlled, and therefore, the material to be heated can be uniformly heated, and in the case of the fixing apparatus, the fixing process can be preferably carried out without causing fixing irregularities on the recording material.

In addition, since the power to be supplied can be switched with higher accuracy, it becomes easier to obtain a desired amount of power supply, whereby the image forming process can be stabilized in the fixing apparatus or in the image forming apparatus.

Since a heater with low thermal capacity is used, the amount of power necessary for heating (fixing images) the material to be heated (recording material) can be switched with higher accuracy, whereby the process of heating the material to be heated can be stably carried out without wasting electricity, and also in the case of the image forming apparatus, a stable image forming process is carried out, contributing to save electricity or energy during the operation of the apparatus.

Hereinabove, the embodiments of the present invention were described. However, the present invention is not bound by these embodiments, and can be modified in various forms within the technological scope.

What is claimed is:

1. An image heating apparatus comprising:

a heater which is stationary in use;

a film movable together with a recording material in sliding contact with said heater, an image on the recording material being heated through said film by the heat from said heater, in a predetermined heating width;

power supply means for supplying alternating power to said heater; and control means for controlling a number of waves of the power imparted to said heater in a predetermined unit of time, wherein the unit of time, a moving speed of said film, and the heating width of said heater satisfy;

the unit of time≦(the heating width)/(the film speed), and wherein the unit of time is an integer multiple of a half cycle of the alternating power.

2. An image heating apparatus according to claim 1, wherein said heater comprises a heat generating layer for generating heat when supplied with the electric power and is disposed in such a manner that a longitudinal direction of said heater is substantially perpendicular to a moving direction of said film, the heating width being a width of said heating resistor layer.

3. An image heating apparatus according to claim 1, wherein said heater comprises a heat generating layer for generating heat when supplied with the electric power, and a highly heat conductive substrate for supporting said heat generating layer, said apparatus further comprising a backup member for forming a nip by being pressed to said heater, with said film interposed therebetween, the heating width being a width of the nip.

4. An image heating apparatus comprising:

a heater which is stationary in use;

a film movable together with a recording material in sliding contact with said heater, and images on the recording material being heated through said film by the heat from said heater;

power supply means for supplying alternating power to said heater;

control means for controlling a number of waves of the alternating power imparted to said heater in a predetermined unit of time;

detecting means for detecting a datum of the alternating power source; and changing means for changing said unit of time in response to a detection result of said detecting means, wherein said unit of time constitutes an integer multiple of a half cycle of the alternating power source.

5. An image heating apparatus according to claim 4, wherein said detecting means detects a voltage of the alternating power source.

* * * * *

UNITED STATES PATENT AND TRADEMARK OFFICE

CERTIFICATE OF CORRECTION

PATENT NO. : 5,367,369
DATED : November 22, 1994
INVENTOR(S) : HIRONOBU NAKAI, ET AL.

It is certified that error appears in the above-indentified patent and that said Letters Patent is hereby corrected as shown below:

Column [57] ABSTRACT,
line 6, "power" should read --a power--.
Figure 7, (in the drawings)
"THERMISTER" should read --THERMISTOR--.
Figure 10, (in the drawings)
"THERMISTER" should read --THERMISTOR--.
Column 1,
line 28, "5,043,736" should read --5,043,763--; and
line 51, "nun%her" should read --number--.
Column 2,
line 20, "an" should read --a--; and
line 35, "is" should read --is a--.
Column 5,
line 19, "Mount" should read --amount--.
Column 6,
line 26, "likes" should read --like--.
Column 12,
line 10, "satisfy;" should read --satisfy:--.

Signed and Sealed this
Thirtieth Day of May, 1995

Bruce Lehman

*Attest:*

BRUCE LEHMAN

*Attesting Officer*

*Commissioner of Patents and Trademarks*